US005265447A

United States Patent [19]

Bilodeau et al.

[11] Patent Number: 5,265,447

[45] Date of Patent: Nov. 30, 1993

[54] DRUM WASHER SEALING

[75] Inventors: Victor L. Bilodeau; Keith P. Vogel; Ron Bain, all of Glens Falls, N.Y.

[73] Assignee: Kamyr, Inc., Glens Falls, N.Y.

[21] Appl. No.: 808,605

[22] Filed: Dec. 17, 1991

[51] Int. Cl.[5] ..... D21C 1/02

[52] U.S. Cl. ..... 68/181 R; 210/402; 277/12

[58] Field of Search ..... 68/43, 158, 181 R, 20; 162/380; 210/402, 404; 277/12; 432/115; 15/303, 306.1, 309.1, 309.2

[56] References Cited

U.S. PATENT DOCUMENTS 3,724,887 4/1973 Roberts ..... 432/115 X
4,248,716 2/1981 LaValley ..... 210/402
4,405,137 9/1983 Webb ..... 432/115 X
4,545,764 10/1985 Gillies et al. ..... 432/115

*Primary Examiner*—Philip R. Coe

*Attorney, Agent, or Firm*—Nixon & Vanderhye

[57] ABSTRACT

A drum washer has improved seal performance by providing a sealing body carried by the drum of a highly corrosion resistant material. The sealing body is preferably polytetrafluoroethylene or titanium, and is connected by mechanical fasteners, instead of welding, to the surrounding drum components. The annular sealing body may have a lip at its axialmost inward portion for engaging the axial outwardmost portion of the drum inner surface, and a radially outwardly extending annular flange which cooperates with a radially inwardly extending flange of the drum outer surface. Alternatively, the body may be smooth and have through-extending openings for receiving mechanical fasteners on its axially inwardmost end, and tapped openings for receiving screw threaded fasteners connected to an extension of the drum inner surface at the axially outwardmost portion.

20 Claims, 4 Drawing Sheets

FIG. 4
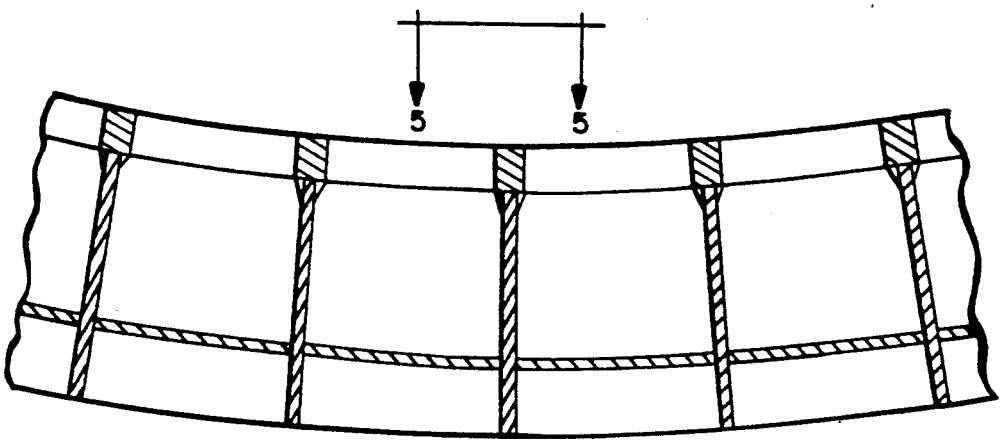
FIG. 6
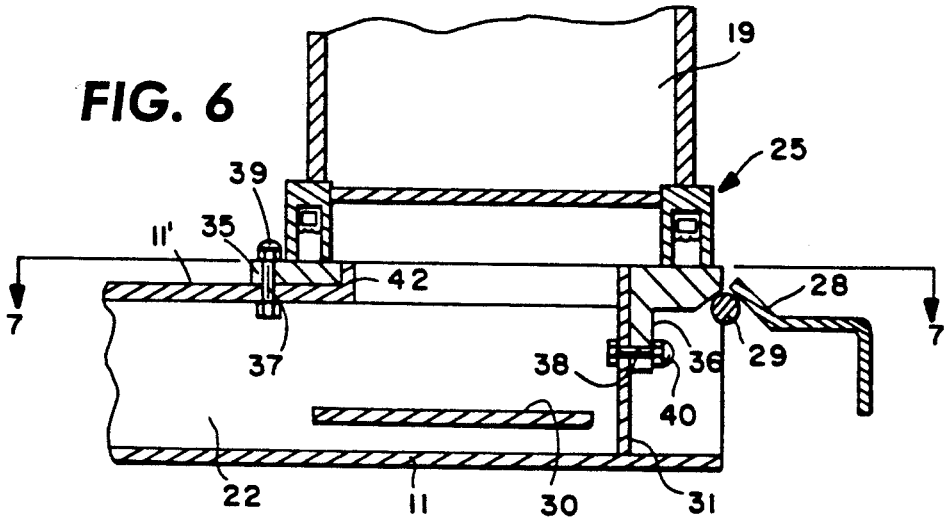
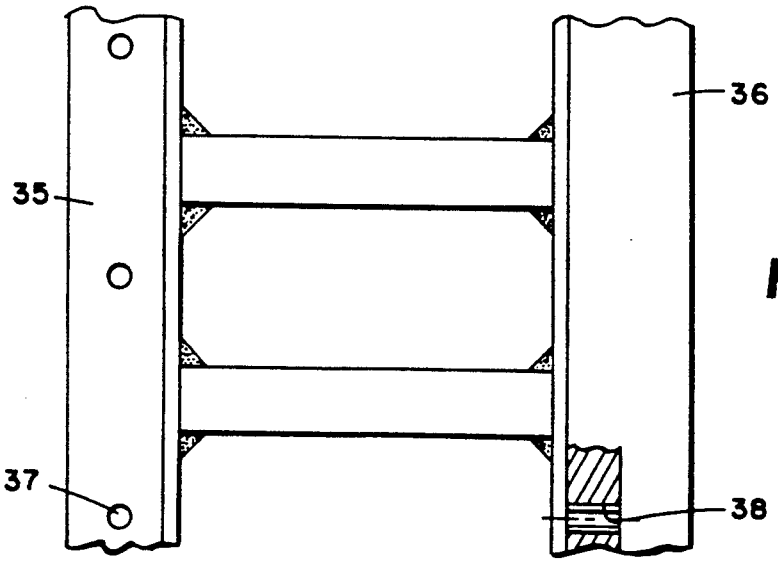
FIG. 7

DRUM WASHER SEALING

BACKGROUND AND SUMMARY OF THE INVENTION

Drum washers are pieces of equipment which operate to effect high efficiency washing of paper pulp, or like slurries. Typical drum washers—such as those sold by Kamyr, Inc. of Glens Falls, N.Y. under the trade designation "M-57 Washer" include a rotating drum having an outer perforated peripheral surface on which the slurry is collected and through which wash water flows, and an inner portion generally concentric with the drum outer perforated peripheral portion at least at the ends thereof. A stationary suction box is provided mounted within the hollow interior of the drum at least at each end thereof, and is connected to a source of vacuum which operates to apply a suction on the drum peripheral portion to cause the slurry solids to cling to the drum peripheral portion as the drum rotates out of a vat. First and second stationary annular sealing surfaces are associated with each suction box, spaced from each other in a dimension parallel to the horizontal axis of the drum, and the rotating drum includes sealing surface means and means for connecting the sealing surface means to the drum for rotation therewith.

The sealing surface means typically used in the prior art are stainless steel blocks, and are welded to the drum, primarily to the drum inner portion and a flange extending radially inwardly from the outer peripheral surface and spaced outwardly from the axialmost outward edge of the drum inner portion. While such drum washers have been commercially successful, there is a higher incidence of failure than desired. According to the invention, it has been recognized that corrosion of the sealing surfaces is the most significant cause of long term breakdown in conventional drum washers, like the Kamyr M-57 washer. Despite the fact that stainless steel is used in such sealing mechanisms, they still corrode in the drum washer environment, being subjected to the pulp slurry, washing liquids, and other chemicals, and when they are subjected to corrosion the seal is ruined thereby eventually making the drum inoperable since sufficient vacuum cannot be applied to the outer peripheral surface.

According to the present invention, the problem associated with conventional drum washers, such as the Kamyr M-57 washer, are solved in a relatively simple yet effective manner by providing high metallurgy sealing surfaces, and a system of mechanical fastening components capable of properly fastening the high metallurgy sealing surfaces in place without the necessity of welding. Typically the sealing surfaces are made of sealing blocks of titanium or polytetrafluoroethylene ("TEFLON"). In any event, the high metallurgy sealing surfaces have corrosion resistance properties that are significantly greater than those of stainless steel.

The corrosion resistant (e.g. titanium or polytetrafluoroethylene) sealing means according to the present invention are connected to the drum by aligned through-extending openings—with mechanical fasteners through them—at one portion of the sealing body, and a lip can be provided on the sealing body for engaging the outer edge of the drum inner portion. At the opposite side, connection is provided by a radially outwardly extending flange which engages the radially inwardly extending flange from the drum outer peripheral portion, in face to face relationship, and there are aligned through extending openings in the flanges which receive mechanical fasteners.

Alternatively, the sealing means body according to the invention may have a smooth outer convex face which engages like face portions associated with the drum interior portion, with through-extending openings and mechanical fasteners through them at the axially innermost edge of the body, and with tapped openings disposed adjacent the axially outermost edge of the body. Screw threaded fasteners extend through an axial surface of the drum inner portion to engage the tapped openings.

The invention also contemplates a sealing mechanism per se comprising an apertured annular integral body curved about an axis, and of a material having corrosion resistant properties significantly greater than those of stainless steel (e.g. consisting essentially of titanium or polytetrafluoroethylene), and comprising a concave inner face, a convex outer face, and means defining openings therein for receipt of mechanical fasteners for fastening the body to another structure. The invention also contemplates a stainless steel drum, per se, having a sealing mechanism as described above.

It is the primary object of the present invention to provide an improved sealing mechanism, particular for sealing surfaces between the rotating drum and stationary suction box of a drum washer. This and other objects of the invention will become clear from an inspection of the detailed description of the invention, and from the appended claims.

BRIEF DESCRIPTION OF THE DRAWINGS

FIG. 4 is a cross-sectional view taken along lines 4—4 of FIG. 3;

FIG. 6 is a view like that of FIG. 3 only showing a first embodiment of sealing mechanism according to the invention;

FIG. 7 is a bottom (outer) view of the sealing body illustrated in FIG. 6, with a portion cut away to show a through extending opening therein;

DETAILED DESCRIPTION OF THE DRAWINGS

Figure 1:
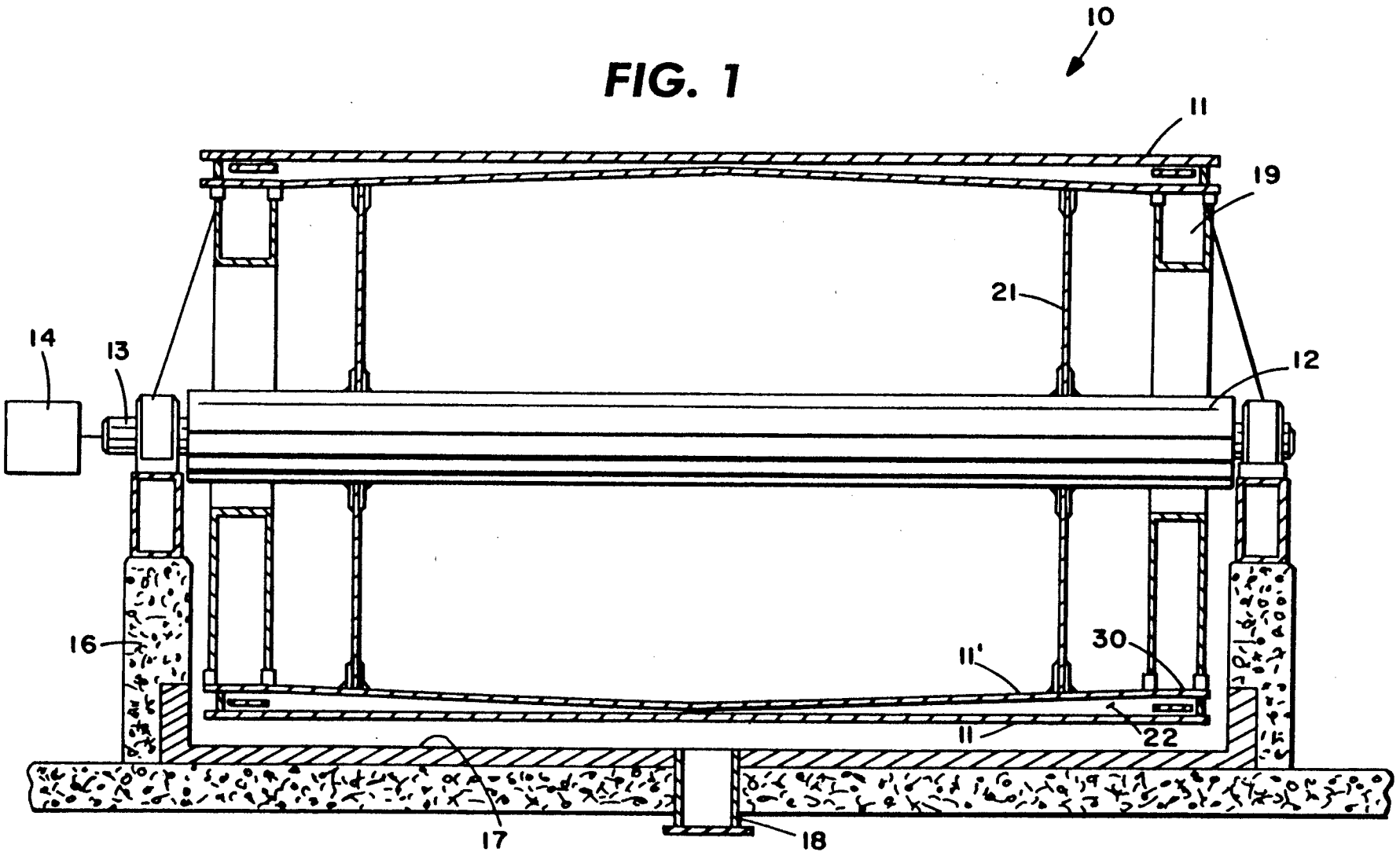
FIG. 1 is a side view, partly in cross-section and partly in elevation, of an exemplary drum washer according to the invention.
Figure 2:
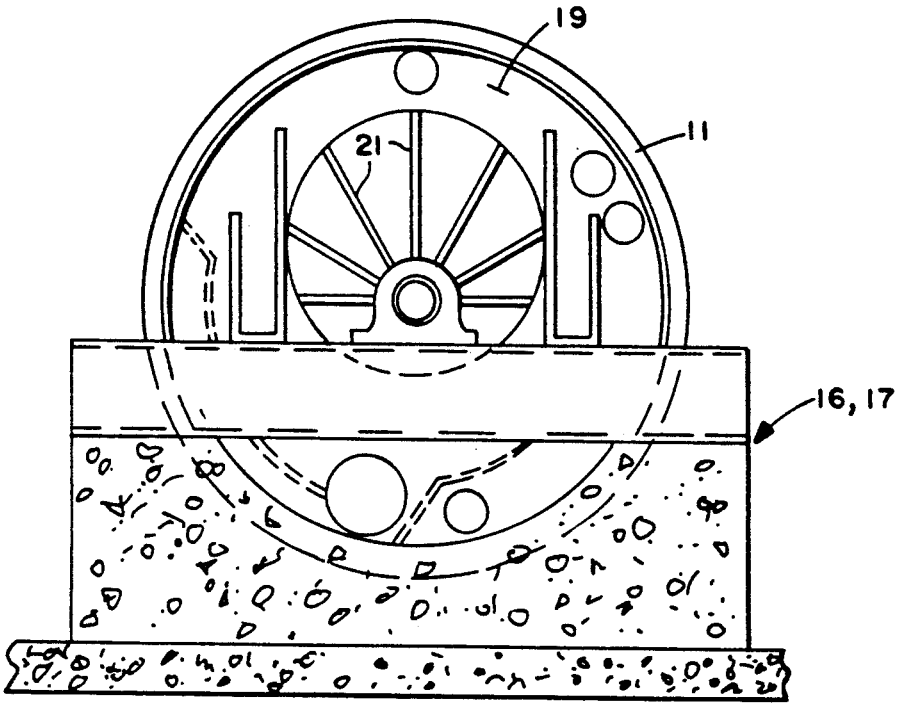
FIG. 2 is an end view of the washer of FIG. 1.

FIG. 1 is a primarily cross-sectional view of an exemplary Kamyr M-57 washer, incorporating the sealing means according to the invention. The standard components of the washer 10 include the drum curved outer perforated peripheral portion 11 on which a pulp sheet forms, which is rotatable about a horizontal axis defined by the concentric shaft portions 12, 13, and driven a conventional motor 14. The drum 11 also includes an inner portion 11' which is a curved solid wall, and generally concentric with the outer peripheral portion 11, at least at the sides (ends) thereof as viewed in FIG. 1.

The volume within the inner portion 11' of the drum is hollow. Drum portions 11, 11' are typically stainless steel.

The drum is typically mounted so that it is within a vat 16, which has a bottom 17 and a normally closed drain 18. A stationary suction box 19 is provided at each of the opposite ends of the drum 11, 11', which provides a suction force causing the slurry to form a sheet on the drum outer peripheral surface 11. Supporting arms or plates 21 connect the inner drum portion 11' to the shaft 12.

Figure 3:
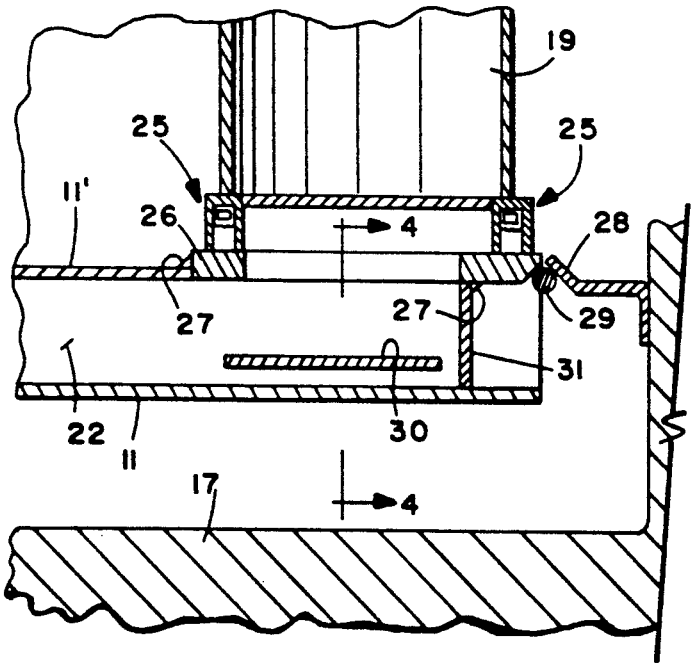
FIG. 3 (PRIOR ART)
FIG. 3 is a detail view of the prior art sealing surfaces associated with the drum and suction box of a conventional version of drum washer such as shown in FIG. 1.
Figure 5:
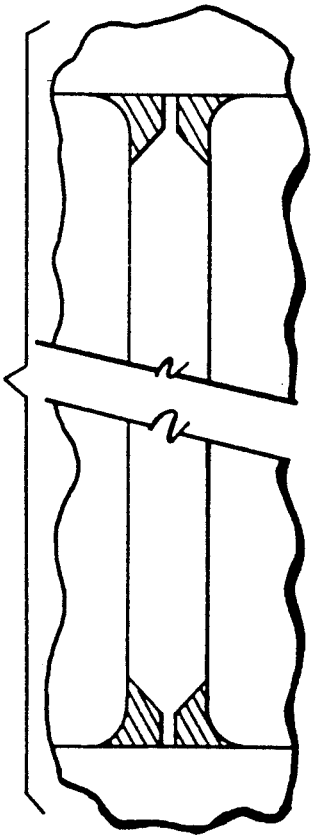
FIG. 5 is a cross-sectional view taken along lines 5—5 of FIG. 4.

As seen in FIG. 3, a volume 22 is defined between the drum portions 11, 11', which volume 22 is annular and is under vacuum as a result of communication with the vacuum source through the suction box 19. First and second annular sealing surfaces 25, spaced from each other in a dimension parallel to the shaft 12, are connected to the suction box 19, and engage sealing surface means, comprising an annular body 26, attached to drum 11, 11'. A bearing mechanism 28, 29 is associated with the drum inner portion 11'—namely through the sealing surface 26, which is an extension thereof. A diverting ring 30 is provided just inside of the outer perforated portion 11 to cover the highest suction portion of the drum, and an annular flange 31 extends radially inwardly from the outer surface 11 of the drum to the stainless steel sealing body 26. Welds 27 are provided for welding the body 26 to the drum inner portion 11' and the radial flange 31, as illustrated in FIG. 3.

The arrangement of the sealing mechanism, suction box, and drum on the left hand side of FIG. 1 is a mirror image of FIG. 3.

The drum washer 10 also will have spray pipes at the wash section thereof (opposite the vat), and typically will have a fan communicating with an interior chamber of an air pick-off section. That is, the drum washer 10 is a conventional drum washer such as shown in a brochure entitled "Kamyr M-57 Washer" reference 181E, the disclosure of which is hereby incorporated by reference herein.

According to one aspect of the present invention, a drum washer 10 is provided which is the same as the drum washer heretofore described except for the details of the sealing surface. A first embodiment of the new sealing means according to the invention is illustrated in FIGS. 6 and 7. The sealing means comprises a body 35 of material having corrosion resistance properties superior to those of stainless steel. Preferably the body 35 is of a material selected from the group consisting essentially of titanium and polytetrafluoroethylene. Also provided are means for connecting the body 35 to the drum 11, 11', which comprises a plurality of mechanical fasteners —that is no welds. Titanium and polytetrafluoroethylene, while having excellent corrosion resistance and being excellent sealing materials, are not heretofore believed to have been thought practical for use as sealing surfaces in drum washers due to the fact that they cannot be welded, in the context of such a mechanism. However, by providing geometric configurations and seats such that only mechanical fasteners need be utilized, they can be properly employed as sealing surfaces.

For the particular embodiment illustrated in FIGS. 6 and 7, the body 35 includes an annular upstanding, radially outwardly extending, flange 36 on the axially outwardmost portion thereof. Mechanical fastening is provided by through extending openings 37, 38 in the axial inwardmost portion of the body 35 and in the flange 36, which are, respectively, in alignment with corresponding through extending openings in the inner portion 11' of the drum, and in the flange 31. Mechanical fasteners, such as the bolts 39, 40, illustrated in FIG. 6, pass through the openings 37, 38 respectively to hold the body 35 in place. Also in this embodiment, it is preferred that a lip 42 be provided extending outwardly from the outer convex surface of the body 35 for engaging the axially outwardmost edge of the drum inner portion 11'.

As can be seen in FIG. 6, the inner concave surface of the annular body 35 engages the sealing surfaces 25 of the suction box 19 as the drum 11 rotates with the sealing body 35 connected thereto. Due to the excellent corrosion resistant properties of the body 35 it will have long life in this environment.

Figure 8:
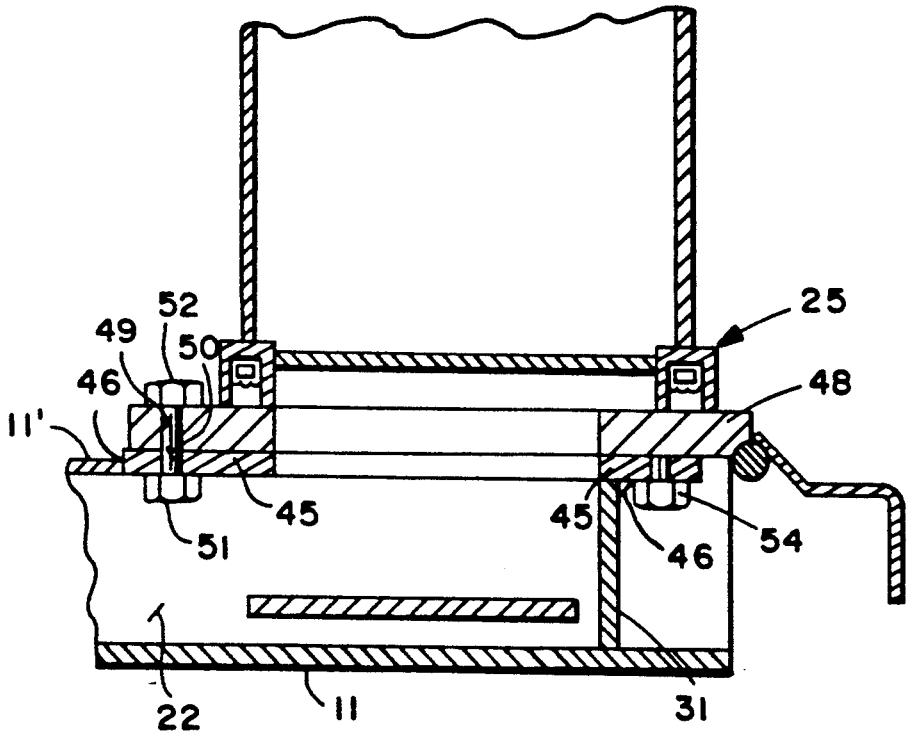
FIG. 8 is a view like that of FIG. 6 for a second embodiment according to the invention.
Figure 9:
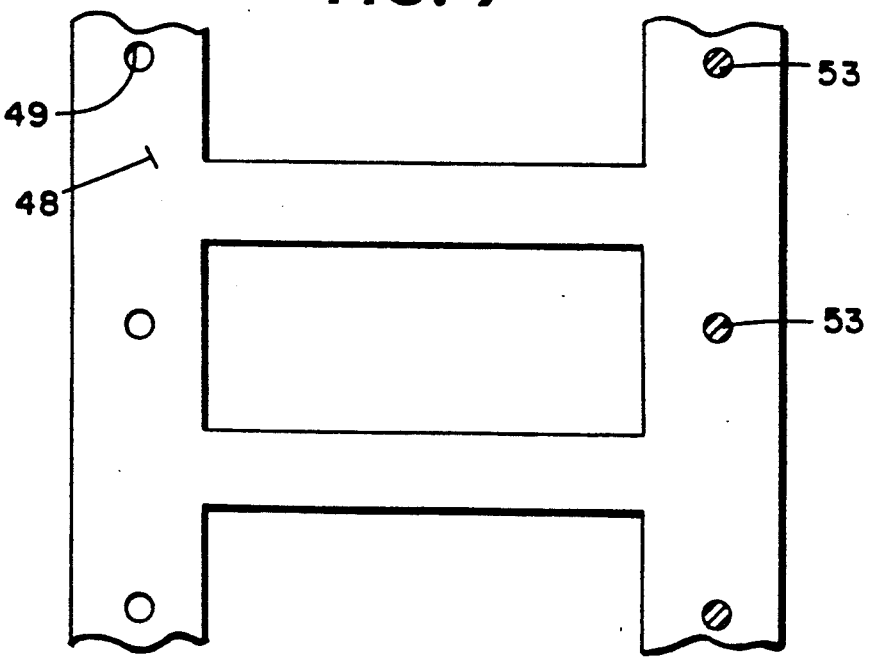
FIG. 9 is a bottom view of the sealing body of FIG. 8.

The embodiment of FIGS. 8 and 9 shows a slightly different shape of the sealing means body of corrosion resistant material according to the invention, and a different means for connecting the body to the drum for rotation therewith.

In the FIGS. 8 and 9 embodiment, an additional, thicker, ring 45 is provided as an extension of the drum inner surface 11'. The ring 45 is of stainless steel or the like, and is welded at points 46 to the axialmost outward edge of the drum inner surface 11', and to the radially inwardly extending annular portion 31. The sealing surface means body 48 according to the invention is of corrosion resistant material, and has a smooth outer convex surface (rather than a radially outwardly extending rib 36 as in the FIGS. 6 and 7 embodiment). Attachment of the left hand side of the sealing body 48 is similar to that in the FIG. 6 embodiment, through extending openings 49 being provided in the body 48 and the ring 45 and with a fastener shaft 50 (e.g. of a rivet or bolt) extending therethrough and being fixed in place by the heads or nuts 51, 52 at opposite ends thereof. At the right hand side of the body 48 there is no room for an attachment mechanism similar to that on the left hand side. Therefore tapped openings 53 (see FIG. 9) are provided in the body 48, with the screw threaded fasteners 54 extending through openings in the ring 45 into the tapped openings 53 and thereby securing the right hand side of the body 48, as viewed in FIG. 8, in place.

While the component parts may be of a wide variety of thicknesses, in the preferred embodiment the body 48 has a thickness of about one inch (the same thickness as the body 35 on the right hand side, without the rib 36, and the same thickness as the body 35 with lip 42 in the FIG. 6 embodiment). The drum inner and outer surfaces 11, 11' have a thickness of about 5/32nds of an inch, and the flange 31 a thickness of about one-quarter inch.

The invention also contemplates, in addition to the combination of the suction box, drum, and sealing means described above, the annular sealing bodies per se is illustrated in FIGS. 6 through 9, and a drum associated with such sealing bodies.

It will thus be seen that according to the present invention sealing means, mounted on a drum, cooperating with a suction box and a drum washer, have been provided which have vastly improved corrosion resistance compared to the prior art. Since applicants have recognized corrosion of the sealing surfaces in prior art drum washers to be the most common long term cause of breakdown, the invention will significantly improve drum washer performance.

While the invention has been herein shown and described in what is presently conceived to be the most practical and preferred embodiment it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A drum washer comprising:

a drum mounted for rotation about a horizontal axis and having an outer perforated peripheral portion with first and second ends, and an inner portion generally concentric with said outer peripheral portion at least at said first end thereof, and a generally hollow interior;

a stationary suction box mounted within the interior of said drum at least at said first end thereof, and connected to a source of vacuum, which operates to apply suction to said drum peripheral portion to cause slurry solids to cling to said drum peripheral portion;

first and second stationary annular sealing surfaces spaced from each other in a dimension parallel to the horizontal axis of said drum, connected to said suction box; and sealing surface means operatively engaging said stationary annular sealing surfaces to provide sealing engagement of said rotating drum therewith, and means for connecting said sealing surface means to said drum for rotation therewith; and wherein said sealing surface means comprises a readily replaceable body of material having corrosion resistance properties superior to those of stainless steel, and wherein said means for connecting said sealing surface means to said drum comprises a plurality of mechanical fasteners.

2. A drum washer as recited in claim 1 wherein said sealing surface means comprises a body of material selected from the group consisting essentially of titanium and polytetrafluoroethylene.

3. A drum washer as recited in claim 2 wherein said drum interior portion includes an inner surface; and wherein said sealing surface means body comprises an apertured annular member having a first inwardly curved face which actually engages said stationary annular sealing surfaces, and a second outwardly curved face opposite said first face, and wherein said second face includes a first, axial inward, portion thereof which engages said drum interior portion inner surface in face to face relationship; and wherein said connecting means comprises means defining a plurality of radially aligned through extending openings in said body and said drum interior portion, and mechanical fasteners passing through said openings.

4. A drum washer as recited in claim 3 wherein said drum interior portion includes a radial edge terminating the axialmost extend of said inner surface thereof; and wherein said sealing surface means body further comprises an integral lip engaging said drum interior portion radial edge.

5. A drum washer as recited in claim 4 wherein said drum further comprises an annular end flange extending radially inwardly from said drum, having a first face that is perpendicular to said drum axis; and wherein said connecting means further includes an annular flange extending radially outwardly from, and integral with, said sealing means body, means defining aligned through extending openings in said drum and body flanges, and mechanical fasteners passing through said aligned openings to fasten said flanges together.

6. A drum washer as recited in claim 3 wherein said drum further comprises an annular end flange extending radially inwardly from said drum, having a first face that is perpendicular to said drum axis; and wherein said connecting means further includes an annular flange extending radially outwardly from, and integral with, said sealing means body, means defining aligned through extending openings in said drum and body flanges, and mechanical fasteners passing through said aligned openings to fasten said flanges together.

7. A drum washer as recited in claim 3 wherein said second face further includes a second, axial outward, portion thereof which engages said drum interior portion inner surface in face to face relationship, axially spaced from the area of engagement of said first portion; and wherein said connecting means further comprises means defining a second plurality of through extending openings in said drum interior portion, and means defining tapped openings in said body aligned with said second plurality of through extending openings, and screw threaded fasteners passing through said second plurality of through extending openings, and engaging said tapped openings.

8. A drum washer as recited in claim 7 wherein said convex outer surface is smooth.

9. A drum washer as recited in claim 2 wherein said drum is stainless steel.

10. A drum washer as recited in claim 1 wherein said drum interior portion includes an inner surface; and wherein said sealing surface means body comprises an apertured annular member having a first inwardly curved face which actually engages said stationary annular sealing surfaces, and a second outwardly curved face opposite said first face, and wherein said second face includes a first, axial inward, portion thereof which engages said drum interior portion inner surface in face to face relationship; and wherein said connecting means comprises means defining a plurality of radially aligned through extending openings in said body and said drum interior portion, and mechanical fasteners passing through said openings.

11. A drum washer as recited in claim 10 wherein said drum interior portion includes a radial edge terminating the axialmost extend of said inner surface thereof; and wherein said sealing surface means body further comprises an integral lip engaging said drum interior portion radial edge.

12. A drum washer as recited in claim 10 wherein said drum further comprises an annular end flange extending radially inwardly from said drum, having a first face that is perpendicular to said drum axis; and wherein said connecting means further includes an annular flange extending radially outwardly from, and integral with, said sealing means body, means defining aligned through extending openings in said drum and body flanges, and mechanical fasteners passing through said aligned openings to fasten said flanges together.

13. A drum washer as recited in claim 10 wherein said convex outer surface is smooth.

14. A stainless steel drum mounted for rotation about a horizontal axis and having an outer perforated peripheral portion with first and second ends, and an inner portion generally concentric with said outer peripheral portion at least at said first end thereof, said inner portion having an inner face, and a generally hallow interior of said drum; and sealing surface means, and means for connecting said sealing surface means to said drum for rotation therewith; said sealing surface means comprising a readily replaceable body of material having corrosion resistance properties superior to those of stainless steel, and said means for connecting said sealing surface means to said drum comprising a plurality of mechanical fasteners.

15. A drum as recited in claim 14 wherein said sealing surface means comprises a body of material selected from the group consisting essentially of titanium and polytetrafluoroethylene.

16. A drum as recited in claim 15 wherein said sealing surface means body comprises an apertured annular member having a first inwardly curved face, and a second outwardly curved face opposite said first face, and wherein said second face includes a first, axially inward, portion thereof which engages said drum interior portion inner surface in face to face relationship; and wherein said connecting means comprises means defining a plurality of radially aligned through extending openings in said body and said drum interior portion, and mechanical fasteners passing through said openings.

17. A drum as recited in claim 15 wherein said drum interior portion includes a radial edge terminating the axialmost extend of said inner surface thereof; and wherein said sealing surface means body further comprises an integral lip engaging said drum interior portion radial edge.

18. A drum as recited in claim 17 wherein said drum further comprises an annular end flange extending radially inwardly from said drum, having a first face that is perpendicular to said drum axis; and wherein said connecting means further includes an annular flange extending radially outwardly from, and integral with, said sealing means body, means defining aligned through extending openings in said drum and body flanges, and mechanical fasteners passing through said aligned openings to fasten said flanges together.

19. A drum as recited in claim 15 wherein said second face further includes a second, axially outward, portion thereof which engages said drum interior portion inner surface in face to face relationship, axially spaced from the area of engagement of said first portion; and wherein said connecting means further comprises means defining a second plurality of through extending openings in said drum interior portion, and means defining tapped openings in said body aligned with said second plurality of through extending openings, and screw threaded fasteners passing through said second plurality of through extending openings, and engaging said tapped openings.

20. A drum as recited in claim 14 wherein said body has an outer convex surface that is smooth.

* * * * *